US011683644B2

(12) United States Patent
Loe et al.

(10) Patent No.: US 11,683,644 B2
(45) Date of Patent: Jun. 20, 2023

(54) ACTIVE NOISE CANCELLATION SYSTEM FOR HELMETS

(71) Applicant: DAAL Noise Control Systems AS, Trondheim (NO)

(72) Inventors: Dag Axel Aarset Loe, Trondheim (NO); Sigmund A. Birkeland, Trondheim (NO)

(73) Assignee: DAAL Noise Control Systems AS, Trondheim (NO)

( * ) Notice: Subject to any disclaimer, the term of this patent is extended or adjusted under 35 U.S.C. 154(b) by 0 days.

(21) Appl. No.: 17/280,679

(22) PCT Filed: Sep. 27, 2019

(86) PCT No.: PCT/EP2019/076292
§ 371 (c)(1),
(2) Date: Mar. 26, 2021

(87) PCT Pub. No.: WO2020/065059
PCT Pub. Date: Apr. 2, 2020

(65) Prior Publication Data

US 2022/0007107 A1 Jan. 6, 2022

(30) Foreign Application Priority Data

Sep. 28, 2018 (GB) ..... 1815899

(51) Int. Cl.
*G10K 11/178* (2006.01)
*H04R 3/02* (2006.01)
*H04R 1/02* (2006.01)

(52) U.S. Cl.
CPC ..... *H04R 3/02* (2013.01); *G10K 11/17823* (2018.01); *H04R 1/025* (2013.01);
(Continued)

(58) Field of Classification Search
CPC ..... G10K 11/17823
See application file for complete search history.

(56) References Cited

U.S. PATENT DOCUMENTS 5,524,058 A 6/1996 Moseley
2003/0228019 A1* 12/2003 Eichler ..... H04R 1/1008 381/71.8

(Continued)

FOREIGN PATENT DOCUMENTS

EP 1 538 601 A2 6/2005
WO 2016/128459 A1 8/2016

OTHER PUBLICATIONS

International Search Report and Written Opinion for corresponding Application No. PCT/EP2019/076292, dated Jan. 21, 2020.

(Continued)

*Primary Examiner* — Ping Lee
(74) *Attorney, Agent, or Firm* — Renner, Otto, Boisselle & Sklar, LLP

(57) ABSTRACT

A helmet including an active noise cancellation (ANC) system which includes a first reference microphone for measuring sound pressure at a first location on a first side of the helmet, the first location between a defined spatial region and a first source of sound and a second reference microphone for measuring sound pressure at a second location, different to the first location, on the first side. The second location is between the defined spatial region and a second source of sound. A loud speaker is provided in or adjacent to the defined spatial region. A control unit determines, based on output signals from the first and second microphones, a drive signal for driving the loudspeaker to generate a sound signal that at least partially attenuates, in the defined spatial region and in the first frequency range, the sound signals from the first and second noise sources.

15 Claims, 3 Drawing Sheets

(52) U.S. Cl.
CPC ..... *G10K 2210/3045* (2013.01); *G10K 2210/511* (2013.01)

(56) References Cited

U.S. PATENT DOCUMENTS

| | | | | |
|---|---|---|---|---|
| 2006/0251266 | A1 | 11/2006 | Saunders | |
| 2012/0215519 | A1 | 8/2012 | Park | |
| 2013/0094657 | A1 | 4/2013 | Brammer | |
| 2014/0086425 | A1* | 3/2014 | Jensen | G10K 11/17817 381/71.11 |
| 2017/0142507 | A1 | 5/2017 | Chang | |
| 2018/0048956 | A1 | 2/2018 | Zukowski | |

OTHER PUBLICATIONS

Search Report for corresponding GB Application No. 1815899.8, dated Feb. 22, 2019.

* cited by examiner

ACTIVE NOISE CANCELLATION SYSTEM FOR HELMETS

TECHNICAL FIELD OF THE INVENTION

This application relates to a system for active noise cancellation in helmets, for use in situations where significant wind noise, or engine/exhaust noise, or other unwanted noise is likely to be present. Such a helmet may be used by, for example, a motorcyclist, bicycle rider, a person engaging in extreme or dynamic sports such as skydiving, alpine skiing, ski jumping, other motor sports etc.

BACKGROUND OF THE INVENTION

It is in principle possible to reduce the effect of wind noise on the user of a helmet by providing the helmet with good passive sound insulating properties. However this adds weight and size to the helmet, and it is not normally practically possible to add enough sound insulating material to achieve satisfactory attenuation of wind noise. Also, providing passive sound insulation material has the potential disadvantage that useful sound information in the mid- to high frequencies (typically above 1 kHz-2 kHz, depending on the sound environment and user scenario) will be attenuated from the user. A motorcyclist, for example, would be unable, or less able, to hear the noise of nearby road vehicles or road users, and this could potentially be dangerous. In general, wind noise and important traffic sounds are in different frequency bands to one another. It is therefore preferable to preferentially attenuate sound in a frequency band that contains unwanted sounds such as wind noise, while providing little or no attenuation in a frequency band that contains potentially useful or important sound information, as this results in an improved environment for the user (by reducing the level of wind noise, or other unwanted noises) while still allowing the user to hear potentially useful or important sound information.

One method of achieving sound attenuation preferentially in one frequency band is active noise control. The basic physical methods of active noise control are known. In these methods a sound is attenuated through use of a noise-cancellation speaker that emits a sound wave with the same amplitude but with opposite phase (also known as "anti-phase", "antinoise" or "antisound") to the original sound. The original sound wave and the sound wave from the noise cancellation speaker destructively interfere with one another to effectively cancel each other out. An example of a helmet with active noise cancellation is described in EP 1 538 601.

In principle complete attenuation of the original sound wave in a desired frequency band may be achieved using active noise control, at least in a region of space. However complete attenuation requires the noise cancellation speaker to generate a sound wave that has exactly equal amplitude to the original sound wave in the desired frequency band, and that is exactly in antiphase to the original sound wave—and this may be difficult to achieve in practice, particularly in cases where the noise environment varies with time as is typically the case for wind noise generated by the helmet of a moving person, or in cases where the sound source(s) might vary with time with regard to their signal characteristics and/or location.

Accordingly, there is a need for an improved active noise cancellation system for a helmet.

SUMMARY

A first aspect of the invention provides a helmet comprising a multichannel feed-forward active noise cancellation (ANC) system for preferentially attenuating sound pressure in a first frequency range in a defined spatial region at a first side of the helmet, the ANC system comprising:

- a first reference microphone for measuring the sound pressure at a first location on the first side of the helmet, the first location between the defined spatial region and a first source of sound;
- a second reference microphone for measuring the sound pressure at a second location on the first side of the helmet, the first location different to the first location, the second location between the defined spatial region and a second source of sound;
- a loudspeaker in or adjacent to the defined spatial region; and
- a control unit for determining, based on output signals from the first and second microphones, a drive signal for driving the loudspeaker to generate a sound signal that at least partially attenuates, in the defined spatial region and in the first frequency range, the sound signals from the first and second noise sources.

As used herein, a "sound of source" refers to a point or region of the helmet that acts as a source of sound. The source may be a point or region of the helmet that actively generates sound, such as a part of the helmet that generates wind noise when air flows over the helmet. Alternatively, the source may be a "virtual source", in that it is a point or region of the helmet from which the wearer of the helmet perceives sound to emanate, even though that sound is generated by a source external to the helmet. For example, in the case of a motorcycling helmet the engine of the motorcycle will generate sound at a location external to the helmet. However, the noise from the engine can represented as having a "virtual source" on the helmet, namely the point(s) on the helmet on the sound path(s) from the engine to the quiet zone.

Referring to a "feed-forward" system does not exclude that the system also comprises one or more feed-back elements.

A virtual source may have fixed location on the helmet, or may have a variable location. Again in the case of a motorcycling helmet, a virtual source corresponding to the engine of the motorcycle will be generally stationary, as the location of the user's head is generally fixed relative to the engine of the motorcycle. However, a source of sound that is external to the motorcycle, for example the horn of another vehicle, may have a virtual source with a variable location on the helmet.

The control unit may determine the drive signal by applying respective filters to the output signals from the first and second microphones and summing the filtered signals.

At least one of the filters may be a frequency-dependent filter.

The helmet may further comprise an error microphone for measuring the sound pressure at a location in or adjacent to the defined spatial region. The control unit may determine, in use, the drive signal based on output signals from the first and second reference microphones and from the error microphone.

The control unit may determine the filters based on the output signal from the error microphone.

The helmet may further comprise a third reference microphone for measuring the sound pressure at a third location on the first side of the helmet, the third location between the defined spatial region and a third source of sound. Alternatively, it may further comprise a third reference microphone for measuring the sound pressure at a third location on the first side of the helmet, the third location between the defined spatial region and the first source of sound.

The first location may be closer to the first source of sound than to the defined spatial region.

The first location may be near the neck opening of the helmet, and the second location may be near the side of a visor of the helmet. The neck opening and the visor are often sources of significant wind noise. Alternatively, the first location and/or the second location may be near another source of noise such as, for example, features such as leading edges of a helmet, a ventilation opening in a helmet, and any other protrusion or edge that causes significant turbulence in the airflow around the helmet and so can act as source of wind noise.

In further embodiments the helmet may further comprise another multichannel feed-forward active noise cancellation (ANC) system for preferentially attenuating sound pressure in another defined spatial region at a second side of the helmet opposite to the first side.

A second aspect of the invention provides a helmet comprising a multichannel feed-forward active noise cancellation (ANC) system for preferentially attenuating sound pressure in a first frequency range in a defined spatial region at a first side of the helmet, the ANC system comprising: a first reference microphone for measuring the sound pressure at a first location on the first side of the helmet, the first location between the defined spatial region and a first source of sound; a loud speaker in or adjacent to the defined spatial region; and a control unit for determining, based on output signals from the first microphone, a drive signal for driving the loudspeaker to generate a sound signal that at least partially attenuates, in the defined spatial region and in the first frequency range, the sound signals from the first noise source. The ANC system may be static or adaptive. Preferred implementations of this aspect may correspond to preferred implementations of the first aspect.

A third aspect of the present invention provides a multichannel feed-forward active noise cancellation (ANC) system suitable for use in a helmet of the first or second aspect.

BRIEF DESCRIPTION OF THE DRAWINGS

Preferred embodiments of the invention will now be described by way of illustrative example with reference to the accompany figures in which.

DETAILED DESCRIPTION OF THE INVENTION

Figure 1:
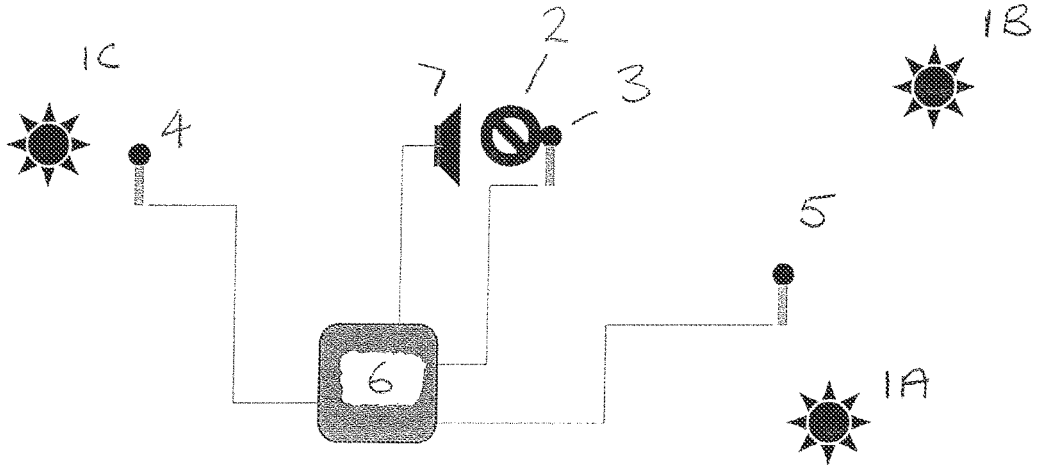
FIG. 1 is a system layout overview of an adaptive multichannel feed-forward ANC (active noise control) system.
Figure 5:
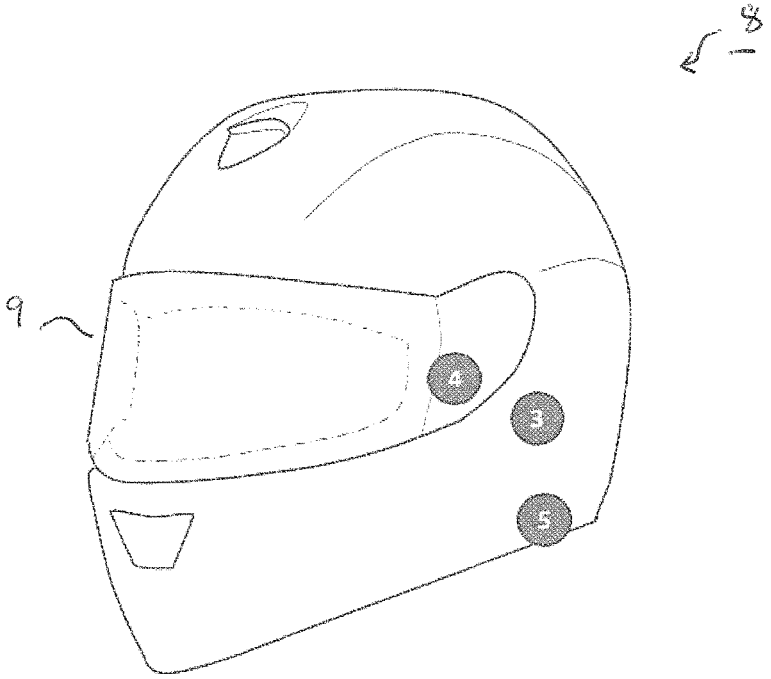
FIG. 5 is a side view of a helmet showing an arrangement of reference microphones according to one embodiment of an ANC helmet.

FIG. 1 shows a general schematic layout of an adaptive multichannel feed-forward ANC system. The sun-signs 1 (a, b and c) indicate examples of locations of sources of unwanted noise, such as wind noise, that it is desired to be attenuated. The goal is to minimize the sound pressure level at a region of space (or "quiet zone") indicated by the stop sign 2, in which the ear of the user will be located when the user is wearing the helmet. (FIG. 1 and FIG. 5 illustrates the layout to produce one quiet zone on one side of the helmet—a second ANC system will be required to provide a second quiet zone on the other side of the helmet for the user's other ear. The two ANC systems may be completely independent from one another, or one or more components (for example such as the control unit) may be common to both ANC systems.)

The overall functionality of the system of FIG. 1 is as follows:

1. The error microphone 3 measures the instantaneous sound pressure level at the location of the quiet zone and provides an output signal indicative of the measured sound pressure level at the location of the quiet zone.
2. Reference microphones 4, 5 each measure the instantaneous sound pressure level at respective locations away from the quiet zone and provide output signals indicative of the measured sound pressure levels at the locations of the reference microphones (known as "reference" signals). The signals are intended to provide information about sound waves travelling towards the desired quiet zone and that will result in sound pressure at the quiet zone at a future time that is determined by the distance of the reference microphone from the quiet zone and the speed of travel of the sound signal, and other properties of the transfer functions between the reference microphone locations and the quiet zone. (It should be noted however that the reference microphones can potentially measure all sound waves at their location, whether or not they are travelling towards the desired quiet zone—so there may be differences between the sound waves actually travelling to the quiet zone and the information about sound waves travelling towards the desired quiet zone obtained from the outputs from the reference microphones. The degree of directionality of the reference microphones and their orientation may affect how accurately the outputs from the reference microphones represent the sound waves actually travelling to the quiet zone.) The use of multiple reference microphones provides a multichannel feed-forward system, as distinct from a single channel feed-forward system, using only one reference microphone.
3. The control unit 6 determines signal filters, by using information from at least the signals from the reference microphones. These filters are applied to the signals from the reference microphones, to generate a drive signal for the loudspeaker 7. The drive signal is then sent to the loudspeaker 7. If the primary path between the noise source or noise sources and the quiet zone changes, or differs from the control units filter estimate or estimates, the corresponding control filter or filters might also change, indicating an adaptive system.
4. At the quiet zone 2, the sound output from the loudspeaker 7 interferes with the noise arriving from the sources 1 of unwanted sound thereby (if the output from the loudspeaker has been determined correctly) reducing the sound pressure level.

In general, the control unit determines the filters using some minimization criteria, for example reducing a parameter of the expected noise at the quiet zone to a minimum or reducing the parameter of expected noise at the quiet zone to be below a threshold value. For example there are known ANC systems that use a "least mean squared" algorithm that seeks to minimise the mean square value of the sound. In some cases the control unit determines the filters so as to preferentially attenuate sound in one frequency range (corresponding to unwanted sound) while not attenuating, or attenuating to a lesser degree, sound in another frequency band (corresponding to useful sound). In outline, information about sound signals that are expected to arrive at the quiet zone at a future time is known from the outputs of the reference microphones. This information can be used to calculate filters that generate a drive signal that causes the loud speaker to emit a sound signal that interferes with the arriving sound signals from the noise sources so as to attenuate the arriving sound signals from the noise source or sources (if the output from the loudspeaker has been determined correctly).

Figure 2:
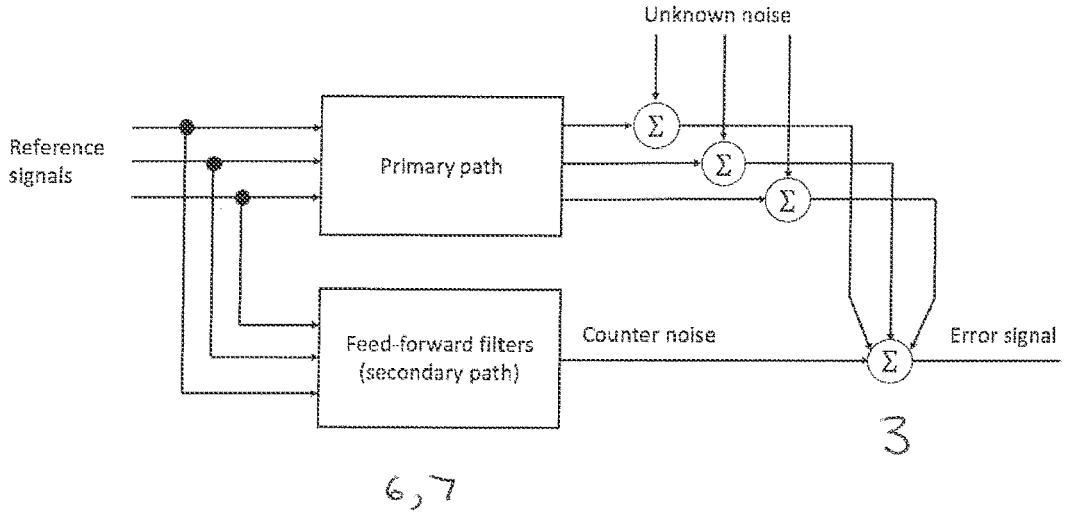
FIG. 2 is a block circuit diagram of a multichannel feed-forward system ANC system, illustrating the primary and secondary paths.

FIG. 2 is a block schematic diagram of an ANC system corresponding to FIG. 1. As shown, there are two sets of paths by which sound can reach the error microphone 3 (which is positioned close to the desired quiet zone and so is assumed to measure the sound pressure at the desired quiet zone), and these sets of paths are referred to as the "primary path" and the "secondary path".

The "primary path" is the set of acoustic paths (transfer functions) from the sound sources 1A, 1B, 10 (one transfer function for each source) of FIG. 1 to the quiet zone. As explained above, a source may be an actual part of the helmet which generates sound, or it may be a "virtual" source that is a point or region of the helmet from which the wearer of the helmet perceives sound to emanate, even though that sound is generated by a source external to the helmet. As also explained above, while it is intended that the information about the sound expected to reach the quiet zone at a particular time from the sources 1A, 1B, 10 is known from the reference signals output from the reference microphones at an earlier time, there is no guarantee that the information is correct. This is indicated in FIG. 2 by adding an "unknown noise" into each channel of the primary path. (A "channel" is a contribution to the sound reaching the quiet zone at a particular time from one of the sound sources 1A, 1B, 10 as determined from the reference signal output from the reference microphone associated with that sound source at an earlier time; FIG. 2 shows 3 channels, corresponding to three reference microphones—so corresponding to a system as shown in FIG. 1 but having three reference microphones rather than the two shown in FIG. 1.) This "unknown noise" can be considered as a prediction error, in that it represents the difference between the sound predicted to arrive at the quiet zone at a given time along a particular channel and the sound that actually arrives at that time along that channel. In general, the "unknown noise" in one channel may be different to the unknown noise in another channel.

The "secondary path" is the set of signal paths through the reference microphones, through the control unit 6, through the loudspeaker 7, and to the quiet zone and the error microphone 3. It is not necessary for the number of sources and reference microphones to be equal, since one microphone can be placed in such a way that it outputs the signal from more than one source (as indicated in FIG. 1). As explained above, the control unit 6 determines the drive signal for the loudspeaker at a particular time based on outputs of the reference microphones for earlier times. Mathematically, the control unit can be considered as determining the drive signal for the loudspeaker by applying a respective filter to the signal from each reference microphone. In this embodiment the control unit and loudspeaker form a "feed-forward" system in that sound signal generated by the loudspeaker is based on the output signals from the reference microphones.

The total sound at the quiet zone is the sum of the sound arriving via the primary path (which is the sound transferred acoustically from the known sources), and the sound arriving via the secondary path (through the reference microphones, the control unit and the loudspeaker 7), as well as the potential "unknown noise".

The actual sound pressure at the quiet zone is measured by the microphone 3 at/close to the quiet zone.

The control unit may be implemented in any convenient way. As one example it may be implemented using a microprocessor or other programmable-logic circuit and as another example it may be implemented as an analogue circuit.

The ANC system of FIG. 2 is a "static system", in which the filters are constant over time. This indicated by the absence of signal path from the error signal back to the controller (as provided by the error microphone in FIG. 1). A static system may be used, either for reasons related to stability of the noise cancellation system, or if the primary path or paths do not change and/or satisfactory attenuation has been achieved. An ANC system can be designed to be static also if the layout contains an error microphone. Other ANC systems are "adaptive", as described below, and in an adaptive stem the process of determining the filters is repeated at fixed or variable intervals based on a measurement of the actual sound pressure at the quiet zone (by the error microphone 3).

One suitable method for determining the adaptive filter is using the "Multichannel Filtered-X Least Mean Squares" algorithm. However, the invention is not limited to this particular method. Examples of some suitable methods are described in the following documents:

Douglas, S. C.: Fast implementations of the filtered-X LMS and LMS algorithms for multichannel active noise control. (https://ieeexplore.ieee.org/document/771315/)

Yuan, J.: Orthogonal adaptation for multichannel feedforward control. (https://www.ncbi.nlm.nih.gov/pubmed/17225399/)

Elliott, S. J.: Optimal controllers and adaptive controllers for multichannel feedforward control of stochastic disturbances. (https://ieeexplore.ieee.org/document/827539/)

Chen, G.; Wan, H.; Chen, K.; Muto, K.: A preprocessing method for multichannel feedforward active noise control. (https://www.jstage.jst.go.jp/article/ast/26/3/26_3_292/_article/)

Thomas, J. K.; Lovstedt, S. P.; Blotter, J. D.; Sommerfeldt, S. D.: Eigenvalue equalization filtered-x algorithm for the multichannel active noise control of stationary and nonstationary signals. (https://www.ncbi.nlm.nih.gov/pubmed/18537375/)

Bouchard, M.; Albu, F.: The multichannel gauss-seidel fast affine projection algorithm for active noise control. (https://ieeexplore.ieee.org/document/1224943/)

Bouchard, M.; Quednau, S.: Multichannel recursive-least-square algorithms and fast-transversal-filter algorithms for active noise control and sound reproduction systems. (https://ieeexplore.ieee.org/document/861382/)

Sicuranza, G. L.; Carini, A.: Nonlinear multichannel active noise control using partial updates. (https://www.researchgate.net/publication/4137062_Nonlinear_multichannel_active_nois e_control_using_partial_updates_acoustic_noise_control)

In the system of FIG. 1 or FIG. 2 the reference microphones 4, 5 sample the sound pressure at a point between a sound source 1 and the quiet zone 2 at a given time. This gives access to a signal that is (hopefully strongly) correlated with the noise expected to arrive at the quiet zone at a future time. If the time difference between the time of sampling the sound pressure and the time at which the samples sound wave is expected to arrive at the quiet zone is greater than the time for a signal to pass through the ANC-system (from a microphone, through the control unit 6, to the speaker 7 and providing sound at the quiet zone), causality enables the system to produce an "anti-noise" that destructively interferes with the sound at the quiet zone, resulting in attenuation of the noise from the noise sources 1 and a reduction in the sound pressure level at the quiet zone. The width of the cross correlation function between reference signal and noise at the quiet zone can compensate somewhat for the lack of a sufficient time difference. Where possible it may be preferable for a reference microphone 4, 5 to be placed near to the sound source(s) that it is intended to monitor, as this increases the time difference of the signal from the reference microphone.

In the case of three noise sources shown in FIG. 1, the ideal drive signal d may be represented as:

$$d(t)=-F_1(t)\{n_1(t-\delta_1)\}-F_2\{n_2(t-\delta_2)\}-F_3\{n_3(t-\delta_3)\} \quad (1)$$

In equation 1, $n_i$ is the sound signal from the $i^{th}$ noise source, $\delta_i$ is the time advancement of the sound signal from the $i^{th}$ noise source, and $F_i$ (t) is the filter/transfer function for the sound signal from the $i^{th}$ noise source at time t.

One challenge with using a feed-forward approach in a helmet for a motorcyclist is the noise characteristics in a motorcycle helmet. There may be several sound sources contributing to the noise at the quiet zone, and these sources may be changing rapidly with regards to location and signal characteristics. If a static feed-forward system is used (meaning that the filter(s) used by the controller 6 to generate the drive signal for the loudspeaker do not change with time but are fixed), attenuation can only be ensured for a specific set of primary paths. Likewise, if a single-channel system with only one reference microphone is used, the causality restraints mentioned above does not enable the system to reach effective attenuation if the location of the source is such that the noise arrives at the quiet zone sooner than the system is able to reproduce a counter signal from its correlated reference signal (unless the autocorrelation of the noise is wide enough for there to be sufficient correlation between reference signal and noise at the quiet zone even when there is little or zero or even negative "time advancement" between reference microphone and quiet zone relative to the incoming noise).

Accordingly, the present invention proposes using an ANC system with multiple reference microphones for reducing wind noise (or other unwanted noises) in helmets. With knowledge about where the dominant areas for turbulence around the helmet (which are the main sources of wind noise in the helmet) are located, and how these contribute to the noise at the ear of the rider, it is possible to implement an ANC system that performs optimally in this setting. The same applies if the noise source is not wind noise, but for example engine/exhaust noise, or other unwanted noises.

For example, features such as leading edges of a helmet; the visor of a helmet, a ventilation opening in a helmet, and any other protrusions or edges that causes significant turbulence in the airflow around the helmet, can act as wind noise sources. External turbulators such as a wind screen, or a motorcycle fairing, can also generate turbulence around the helmet. For a particular design of helmet, sources of wind noise or other noise can be identified, as can the desired location for the quiet zone. The positions of the reference microphones may then be determined based on the locations of the identified sources of wind noise or other noises that it is desired to attenuate, such that microphones are provided on the helmet between the selected sources of noise and the quiet zone. With the microphone placement such that the distance between a reference microphone and the quiet zone being large enough so that each reference signal is determined at a sufficiently early time (relative to the arrival time at the quiet zone through the primary path, of the sound measured at the reference microphone) to meet the causality and correlation restraints mentioned above, in order to provide noise attenuation.

Figure 3:
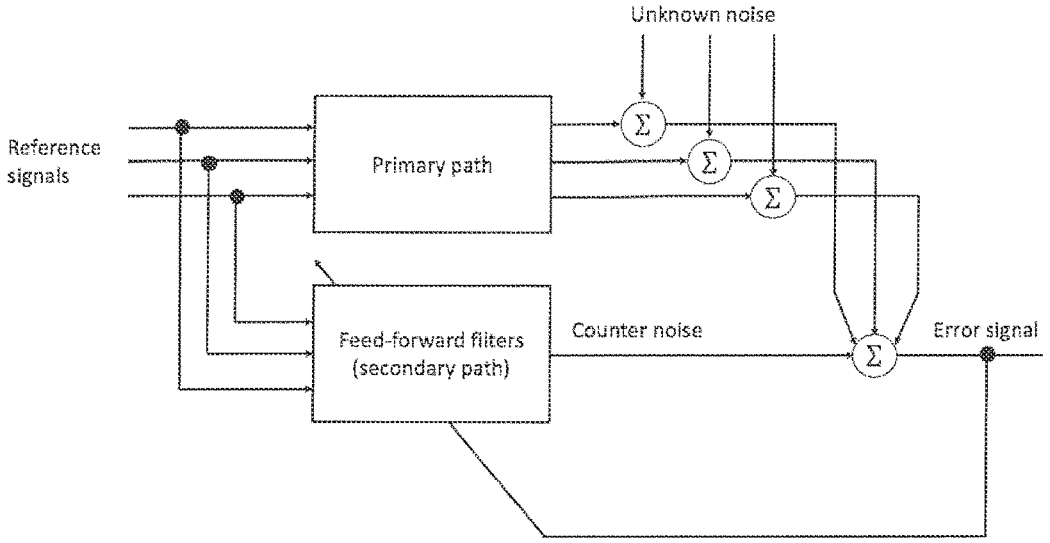
FIG. 3 is a block diagram of an adaptive multichannel feed-forward system ANC system.

A schematic block diagram for an adaptive multichannel feed-forward ANC-system is shown in FIG. 3. This corresponds generally to the static ANC system of FIG. 2, but the control unit 6 further receives the signal ("error signal") from the error microphone 3 as a further input. Ideally the error signal is zero (at least for a specific frequency range), indicating that the counter noise generated by the loudspeaker 7 has provided good attenuation of the unwanted noise from the noise sources 1 (or has provided good attenuation of the unwanted noise in the specific frequency range). If the error signal is not zero, or small, this indicates that perfect attenuation has not been achieved. As shown in FIG. 3, the error signal may be used as input in the determination of the filters.

Compared to the static ANC system of FIG. 2, the adaptive ANC system of FIG. 3 is more suitable in cases where the unwanted noise from the noise sources 1A, 1B, 1C varies over time, either because the locations of the sources are changing or because the characteristics of the noise from the noise sources are changing.

Figure 4:
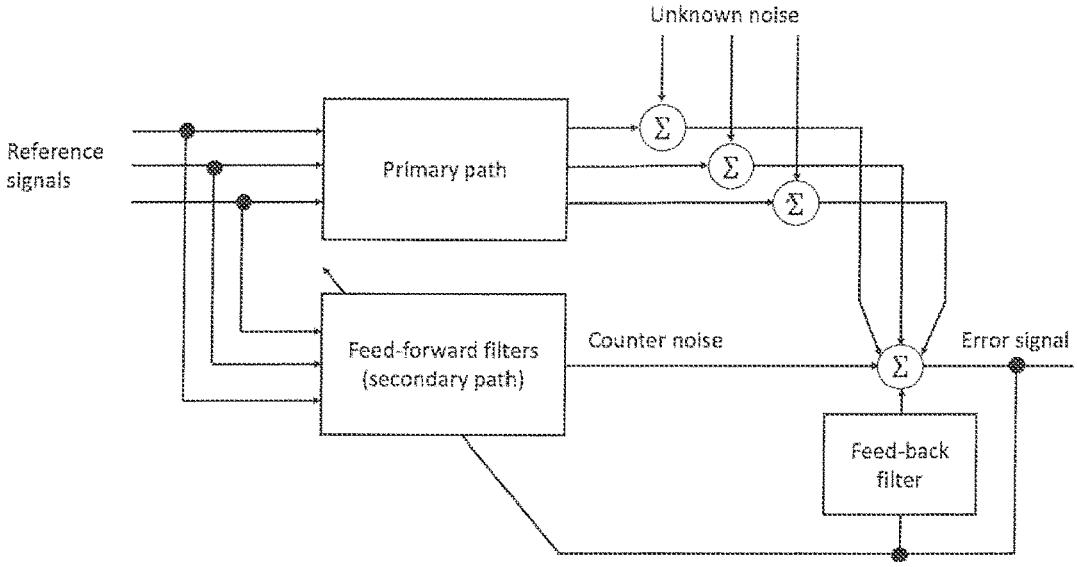
FIG. 4 is a block diagram of a hybrid multichannel feed-forward system ANC system.

Another schematic block diagram for an adaptive multichannel ANC-system incorporating feed-forward control is shown in FIG. 4. The system of FIG. 4 additionally includes a parallel feed-back filter. In the feed-back topology the signal from the error microphone itself is used as a reference signal. In other words, the error signal is being filtered and sent through the loudspeaker. The filter in this feed-back topology can be adaptive or static. The figure does not show the loudspeaker specifically, so its contribution to the signal path is included in both the "secondary path" block, and the "feed-back filter" block. It is possible to use either separate or the same loudspeaker for the feed-forward and the feed-back path. The ANC system of FIG. 4 included both feed-forward and feed-back control of the sound pressure at the quiet zone, and so may be considered as a "hybrid".

FIG. 5 shows examples of possible locations for reference microphones 4, 5 and the error microphone 3. The reference microphones will be placed near the areas where dominant noise sources are located, while the error microphone 3 will be located inside the helmet near the ear of the rider. The loudspeaker will also be mounted inside the helmet near the ear of the rider.

FIG. 5 shows examples of possible locations for reference microphones 4, 5 and the error microphone 3 on the left side of the helmet, i.e. for the wearer's left ear. As noted, the helmet can be provided with a second ANC system for generating a quiet zone on the right side of the helmet for the wearer's right ear. Generally the reference microphones and error microphone of the right side ANC will be arranged in corresponding locations to the reference microphones and error microphone of the left side ANC, but in principle the right side ANC system and the left side ANC system could be different from one another. The left side ANC system and the right side ANC system may share a common control unit, or they may each have a separate control unit.

Two examples of suitable locations for the reference microphones are shown in FIG. 5. The reference microphone 4 is at or near the side of a visor 9 of the helmet 8, for example at approximately eye/cheek height, and the reference microphone 5 is near the neck opening of the helmet. However, these locations are by way of example, and the invention does not require that the reference microphones are located as shown in FIG. 5. Also, as noted, the ANC system is not limited to two reference microphones and for example may include more than two reference microphones.

In addition to the microphones, loudspeaker and the controller, the ANC system will require components like such as, for example, one or more of an amplifier to drive the loudspeaker, battery to power the system, AD-DA-converters if the system is implemented as a digital controller, and interface etc. These may be provided in the helmet, or in principle one or more of them could be provided separately from the helmet (for example on the motorcycle in the case of a motorcycling helmet).

Components provided on the helmet may preferably be encapsulated to provide physical protection against wear and/or against an impact on the helmet.

The interior of the helmet at the location of the quiet zone may be configured to form an ear cup or other similar shape.

Many motorcycle helmets (and other helmets) now incorporate a communication system, such as a Bluetooth communication system, to allow the wearer to more easily communicate with other people (for example other motorcyclists), and/or to connect to other devices such as phones. Where the present invention is applied to such a helmet, one or both ANC systems could be combined with the communication system, and/or other helmet integrated multimedia systems to avoid duplication of components.

It will be understood that the above embodiments are described by way of example only, and that variations are possible. For example, the invention may alternatively be implemented using an ANC system having only one reference microphone, or having three or more reference microphones. In principle the ANC system on one side of the helmet could have a different number and/or different arrangement of reference microphones than the ANC system on the other side of the helmet.

The invention claimed is:

1. A helmet comprising a multichannel feed-forward active noise cancellation (ANC) system for preferentially attenuating sound pressure in a first frequency range in a defined spatial region at a first side of the helmet, the ANC system comprising:

a first reference microphone for measuring the sound pressure at a first location on the first side of the helmet, the first location between the defined spatial region and a first source of sound, and being near the first source of sound;

a second reference microphone for measuring the sound pressure at a second location on the first side of the helmet, the second location different to the first location, the second location between the defined spatial region and a second source of sound, and being near the second source of sound;

a loud speaker in or adjacent to the defined spatial region; and a control unit for determining, based on output signals from the first and second microphones, a drive signal for driving the loudspeaker to generate a sound signal that at least partially attenuates, in the defined spatial region and in the first frequency range, the sound signals from the first and second source of sound;

wherein a neck opening of the helmet represents the first source of sound, the defined spatial region is adjacent an ear of a user of the helmet, and the first location at which the first reference microphone measures the sound pressure is closer to the neck opening than the defined spatial region.

2. The helmet as claimed in claim 1, wherein the control unit determines the drive signal by applying respective filters to the output signals from the first and second microphones and summing the filtered signals.

3. The helmet as claimed in claim 2 wherein at east one of the filters is a frequency-dependent filter.

4. The helmet as claimed in claim 1 and further comprising an error microphone for measuring the sound pressure at a location in or adjacent to the defined spatial region;

wherein the control unit determines, in use, the drive signal based on output signals from the first and second reference microphones and from the error microphone.

5. The helmet as claimed in claim 4 wherein the control unit determines the drive signal by applying respective filters to the output signals from the first and second microphones and summing the filtered signals, and the control unit determines the filters based on the output signal from the error microphone.

6. The helmet as claimed in claim 1 and further comprising a third reference microphone for measuring the sound pressure at a third location on the first side of the helmet, the third location between the defined spatial region and a third source of sound.

7. The helmet as claimed in claim 1 and further comprising a third reference microphone for measuring the sound pressure at a third location on the first side of the helmet, the third location between the defined spatial region and the first source of sound.

8. The helmet as claimed in claim 1, wherein a side of a visor of the helmet represents the second source of sound, the defined spatial region is adjacent the ear of the user of the helmet, and the second location at which the second microphone measures the sound pressure is closer to the side of the visor than the defined spatial region.

9. A helmet comprising a multichannel feed-forward active noise cancellation (ANC) system for preferentially attenuating sound pressure in a first frequency range in a defined spatial region at a first side of the helmet, the ANC system comprising:

a first reference microphone for measuring the sound pressure at a first location on the first side of the helmet, the first location between the defined spatial region and a first source of sound, and being near the first source of sound;

a second reference microphone for measuring the sound pressure at a second location on the first side of the helmet, the second location different to the first location, the second location between the defined spatial region and a second source of sound, and being near the second source of sound;

a loud speaker in or adjacent to the defined spatial region; and a control unit for determining, based on output signals from the first and second microphones, a drive signal for driving the loudspeaker to generate a sound signal that at least partially attenuates, in the defined spatial region and in the first frequency range, the sound signals from the first and second source of sound;

wherein a side of a visor of the helmet represents the second source of sound, the defined spatial region is adjacent an ear of a user of the helmet, and the second location at which the second microphone measures the sound pressure is closer to the side of the visor than the defined spatial region.

10. The helmet as claimed in claim 9, wherein the control unit determines the drive signal by applying respective filters to the output signals from the first and second microphones and summing the filtered signals.

11. The helmet as claimed in claim 10 wherein at least one of the filters is a frequency-dependent filter.

12. The helmet as claimed in claim 9 and further comprising an error microphone for measuring the sound pressure at a location in or adjacent to the defined spatial region;

wherein the control unit determines, in use, the drive signal based on output signals from the first and second reference microphones and from the error microphone.

13. The helmet as claimed in claim 12 wherein the control unit determines the drive signal by applying respective filters to the output signals from the first and second microphones and summing the filtered signals, and the control unit determines the filters based on the output signal from the error microphone.

14. The helmet as claimed in claim 9 and further comprising a third reference microphone for measuring the sound pressure at a third location on the first side of the helmet, the third location between the defined spatial region and a third source of sound.

15. The helmet as claimed in claim 9 and further comprising a third reference microphone for measuring the sound pressure at a third location on the first side of the helmet, the third location between the defined spatial region and the first source of sound.

* * * * *